US008919672B2

(12) United States Patent
Chen

(10) Patent No.: US 8,919,672 B2
(45) Date of Patent: Dec. 30, 2014

(54) WASHING APPARATUS WITH ADJUSTABLE WATER SPRAYING HEAD

(75) Inventor: Chin-Yuan Chen, Changhua (TW)

(73) Assignee: Shin Tai Spurt Water of the Garden Tools Co. Ltd., Changhua (TW)

( * ) Notice: Subject to any disclaimer, the term of this patent is extended or adjusted under 35 U.S.C. 154(b) by 268 days.

(21) Appl. No.: 13/473,496

(22) Filed: May 16, 2012

(65) Prior Publication Data

US 2013/0306761 A1 Nov. 21, 2013

(51) Int. Cl.

| | |
|---|---|
| ***B05B 15/06*** | (2006.01) |
| ***B05B 7/02*** | (2006.01) |
| ***B05B 9/01*** | (2006.01) |
| ***B05B 15/08*** | (2006.01) |
| ***B05B 1/26*** | (2006.01) |
| ***E04B 7/02*** | (2006.01) |
| ***E04D 13/076*** | (2006.01) |
| ***B08B 3/02*** | (2006.01) |

(52) U.S. Cl.

CPC ..... *B05B 1/267* (2013.01); *B05B 15/08* (2013.01); *B05B 15/066* (2013.01); *E04B 7/02* (2013.01); *E04D 13/0765* (2013.01); *B08B 3/028* (2013.01)

USPC ..... 239/532; 239/525; 239/280.5; 239/587.1; 239/587.5

(58) Field of Classification Search

USPC ..... 239/280, 280.5, 532, 587.1, 587.2, 239/587.5, 587.6; 15/414

See application file for complete search history.

(56) References Cited

U.S. PATENT DOCUMENTS

| | | | | | |
|---|---|---|---|---|---|
| 3,041,655 | A * | 7/1962 | Entler | 401/263 |
| 3,908,910 | A * | 9/1975 | Detwiler | 239/280 |
| 4,150,793 | A * | 4/1979 | Russo | 239/532 |
| 4,303,348 | A * | 12/1981 | O'Brien | 401/137 |
| 4,304,498 | A * | 12/1981 | George | 401/9 |
| 4,319,851 | A * | 3/1982 | Arthur | 401/137 |
| 4,349,039 | A * | 9/1982 | Egger | 134/167 C |
| 4,750,883 | A * | 6/1988 | Drake | 401/137 |
| 5,022,586 | A * | 6/1991 | Putnam | 239/71 |
| 5,390,853 | A * | 2/1995 | Ellul | 239/282 |
| 5,725,322 | A * | 3/1998 | Evans | 401/42 |
| 5,988,715 | A * | 11/1999 | Mason | 294/181 |
| 6,508,415 | B2 * | 1/2003 | Wang | 239/526 |
| 6,511,001 | B1 * | 1/2003 | Huang | 239/526 |
| 6,540,163 | B1 * | 4/2003 | Huang | 239/587.5 |
| 6,595,439 | B1 * | 7/2003 | Chen | 239/225.1 |
| 6,951,311 | B1 * | 10/2005 | Moran | 239/532 |
| 7,427,038 | B2 * | 9/2008 | Wang et al. | 239/240 |
| 2005/0109863 | A1 * | 5/2005 | Chen | 239/532 |

(Continued)

*Primary Examiner* — Melanie Tyson
*Assistant Examiner* — Thomas Berez
(74) *Attorney, Agent, or Firm* — Che-Yang Chen; Law Office of Michael Chen

(57) ABSTRACT

A washing apparatus with an adjustable water spraying head includes a water inlet tube, a water guiding tube and a water spraying head. A second connecting base of the water guiding tube engages with a first connecting base of the water inlet tube. A plurality of first positioning holes that are against a first positioning unit of the water inlet tube are circularly formed at the engaging side. The water spraying head is plugged into a water outlet end of the water guiding tube, and a second positioning unit is located at an outer periphery of a connecting tube. The second positioning unit is against a second spring and wedged in a second positioning hole of the water guiding tube. According to the structure stated above, the adjustment of the water spraying head is more convenient without frequently moving the water inlet tube, which causes water to spray randomly.

8 Claims, 10 Drawing Sheets

(56) References Cited

U.S. PATENT DOCUMENTS

2005/0125945 A1* 6/2005 Park ..... 15/414
2006/0283982 A1* 12/2006 Wang ..... 239/530
2008/0022488 A1* 1/2008 Dant et al. ..... 15/414
2010/0288854 A1* 11/2010 Felknor et al. ..... 239/532
2010/0294859 A1* 11/2010 Chen ..... 239/548

* cited by examiner

WASHING APPARATUS WITH ADJUSTABLE WATER SPRAYING HEAD

FIELD OF THE INVENTION

The present invention relates to a washing apparatus with an adjustable water spraying head, and more particularly to a washing apparatus that can change an angle of elevation of a water guiding tube or water outlet direction of the water spraying head, and the water guiding tube and the water spraying head can be adjusted both independently and dependently.

BACKGROUND OF THE INVENTION

Most buildings that have eaves have water collecting troughs underneath to collect the rain flowing down from the eaves and guide the rain to the drainpipe or to discharge on the ground. The water collecting trough has to be cleaned frequently to avoid clogging by sand, leaves, branches, etc carried by rain. Thus, some people developed a water spraying device to clean the water collecting trough as shown in FIGS. 10 and 11. The water spraying device has a water inlet unit (40) that has a water inlet end (41) underneath to connect to a water supply. A water control valve (42) is located near the water inlet end (41) to control the amount of water input, and a water guiding channel (43) that is bended forward is disposed on an upper portion of the water inlet unit (40), the water guiding channel (43) connecting to a flat water outlet head (44) at the rear end. When in use, the water spraying device is moved upward so the water outlet head (44) can be aligned with the water collecting trough. Meanwhile, the water control valve (42) is turned on, so water can flow from the water inlet unit (40) and the water guiding channel (43) to the flat water outlet head (44) to form a strong water column to clean the water collecting trough. However, the angle of the water guiding channel (43) is fixed, and the water spraying direction of the water outlet head (44) is fixed as well, so when the user wants to clean the water collecting trough, the user has to move the water inlet unit (40) to indirectly adjust the angle of washing, since the water inlet unit must be moved frequently and water may randomly spray and splash the user.

Therefore, there remains a need for a new and improved washing device having an adjustable water outlet head to achieve the goal of convenience and easy operation to overcome the problems stated above.

SUMMARY OF THE INVENTION

The problem the present invention solves is that the angle of the water guiding channel is fixed, and the water spraying direction of the water outlet head is fixed as well, so when the user wants to clean the water collecting trough, the user has to move the water inlet unit to indirectly adjust the angle of washing, which is inconvenient and the since the water inlet unit is moved frequently, the water may randomly spray and splash the user.

To solve and overcome the problems stated above, the present invention provides a washing apparatus with an adjustable water spraying head including a water inlet tube, a water guiding tube and a water spraying head. A first connecting base is located on one side above the water inlet tube, and a first flowing space is recessedly formed in the first connecting base, and a through hole is formed at one side of the first flowing space to connect to the water inlet tube. A rod is protrudingly formed at center of the first flowing space, and a connecting hole is recessedly formed at the rod. A receiving space is formed outside the first flowing space, and the receiving space has a first spring and a first positioning unit inside. Behind the water guiding tube is a second connecting base engaging with the first connecting base of the water inlet tube. A plurality of first positioning holes are circularly formed at the engaging side of the second connecting base, and the first positioning hole is against the first positioning unit of the water inlet tube. A through opening is provided for the rod of the water inlet tube at center of the engaging side, and the other side of the through opening has a restricting unit and a cover, and the restricting unit passes through the through opening to engage with the connecting hole of the water inlet tube. Also, a second flowing space is recessedly formed between the through opening and the first positioning hole corresponding to the first flowing space, and a water outlet end is formed underneath the water guiding tube to connect with the second flowing space, and a plurality of second positioning holes are circularly formed at the opening of the water outlet end. A water spraying hole is located underneath the water spraying head, and a connecting tube extends from the water spraying head to plug into the water outlet end of the water guiding tube. A receiving hole is recessedly formed outside the connecting tube, and the receiving hole has a second spring and a second positioning unit, wherein the second positioning unit is against the second spring and located at the second positioning hole of the guiding tube. The washing apparatus with an adjustable water spraying head is thus obtained.

Compared with the conventional arts, the present invention is advantageous because it can change the angle of elevation of the water guiding tube or the water output direction of the water spraying head. Furthermore, adjustment of the water guiding tube and the water spraying head can be either dependent or independent, so the adjustment of the water spraying head is more convenient without frequently moving the water inlet tube, which causes water to spray randomly.

DETAILED DESCRIPTION OF THE INVENTION

Figure 1:
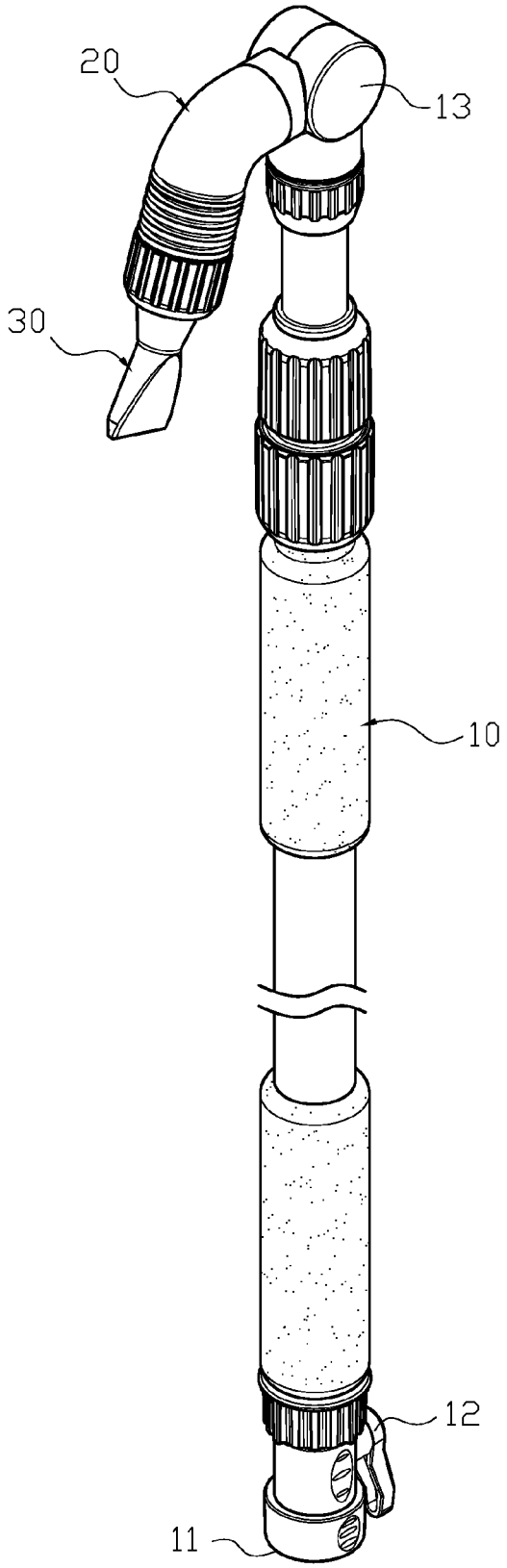
FIG. 1 illustrates a three-dimensional view of the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides a washing apparatus with an adjustable water spraying head including a water inlet tube (10), a water guiding tube (20) and a water spraying head (30). A water inlet end (11) is located underneath the water inlet tube (10), and a water control valve (12) is disposed near the water inlet end (11) to adjust the amount of inlet water. A first connecting base (13) is located on one side above the water inlet tube (10), and a first flowing space (14) is recessedly formed in the first connecting base (13), and a through hole (141) is formed at one side of the first flowing space (14) to connect to the water inlet tube (10). A rod (15) is protrudingly formed at center of the first flowing space (14), and a connecting hole (151) is recessedly formed at the rod (15). A receiving space (16) is formed outside the first flowing space (14), and the receiving space (16) has a first spring (161) and a first positioning unit (162) inside, and a restricting slot (17) is recessedly formed near the receiving space (16). Behind the water guiding tube (20) is a second connecting base (21) engaging with the first connecting base (13) of the water inlet tube (10). A plurality of first positioning holes (22) and a block (23) are circularly formed at the engaging side of the second connecting base (21), wherein the first positioning hole (22) is against the first positioning unit (162) of the water inlet tube (10), and the block (23) is inserted into the restricting slot (17) of the water inlet tube (10), and against both sides of the opening of the restricting slot (17) to form a secured position. A through opening (24) is provided for the rod (15) of the water inlet tube (10) at center of the engaging side, and the other side of the through opening (24) has a restricting unit (241) and a cover (242), wherein the restricting unit (241) passes through the through opening (24) to engage with the connecting hole (151) of the water inlet tube (10), and the cover (242) is used to achieve the goal of hiding the restricting unit (241). Also, a second flowing space (25) is recessedly formed between the through opening (24) and the first positioning hole (22) corresponding to the first flowing space (14), and a water outlet end (26) is formed underneath the water guiding tube (20) to connect with the second flowing space (25). An elongated stopping rib (261) is protrudingly formed at an inner periphery of the water outlet end (26), and a plurality of second positioning holes (262) are circularly formed at the opening of the water outlet end (26). A water spraying hole (31) is located underneath the water spraying head (30), and a flow guiding board (311) extends from the edge of the water spraying hole (31), wherein the flow guiding board (311) is fan-shaped, and a stopping surface (312) is formed on both sides thereof, so that the output water can generate a fan-shaped spraying surface. A connecting tube (32) extends from the water spraying head (30) to plug into the water outlet end (26) of the water guiding tube (20). A semi-circular stopping portion (321) is protrudingly formed at an upper portion of the connecting tube (32), and the semi-circular stopping portion (321) can be against the elongated stopping rib (261) of the water guiding tube (20) to form a stopping and secured position, and the body of the connecting tube (32) has a sealing gasket (322). A receiving hole (33) is recessedly formed outside the connecting tube (32), and the receiving hole (33) has a second spring (331) and a second positioning unit (332), wherein the second positioning unit (332) is against the second spring (331) and located at the second positioning hole (262) of the guiding tube (20). The water spraying head (30) has a connecting edge (34) protrudingly formed at outer periphery thereof and a restricting cover (35), one end of which covers outer periphery of the water outlet end (26) of the water guiding tube (20), and an engaging edge (351) is protrudingly formed at inner periphery of the other end. The engaging edge (351) is against the connecting edge (34) to form a restricting position.

Figure 2:
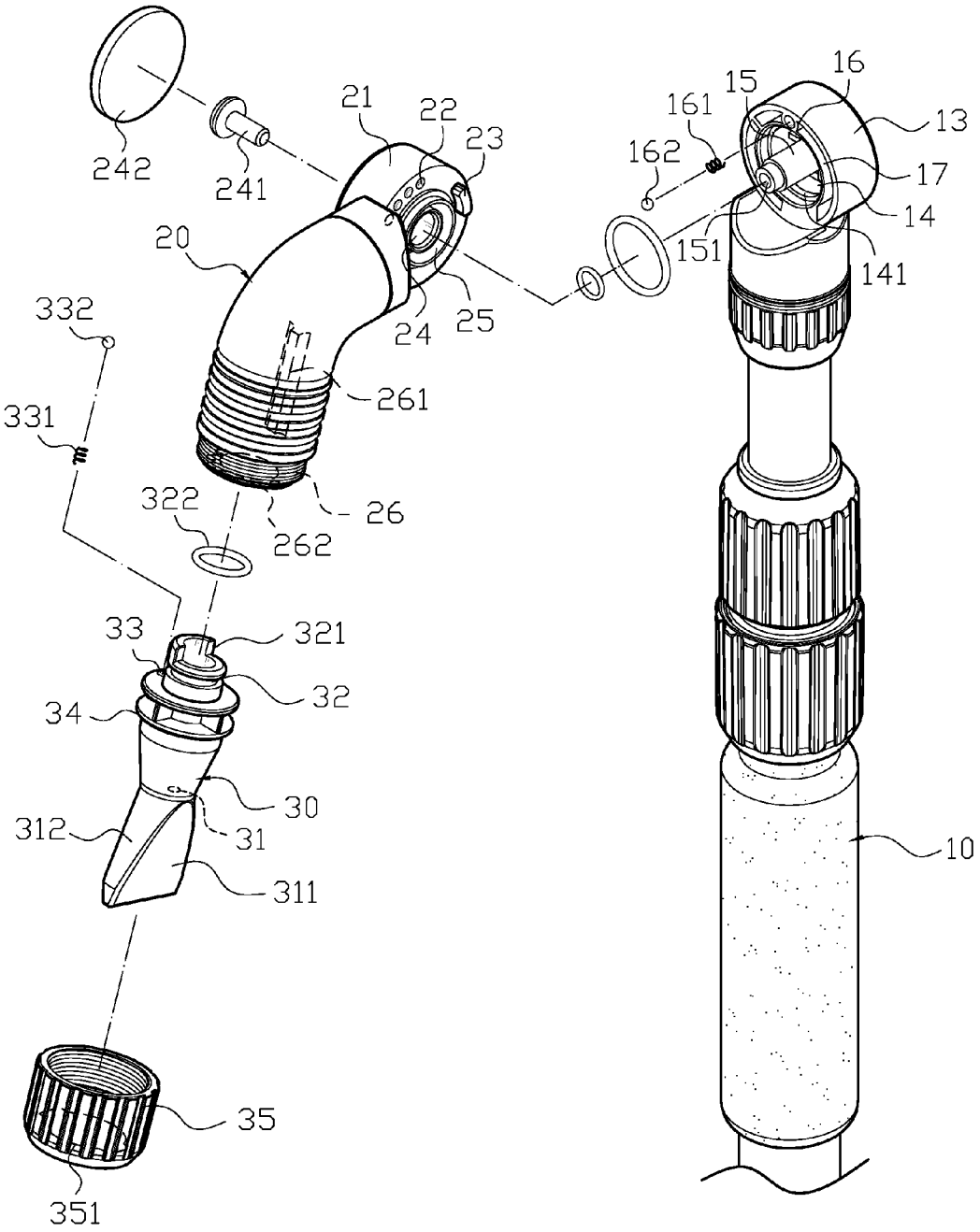
FIG. 2 illustrates a three-dimensional exploded view of the present invention.
Figure 3:
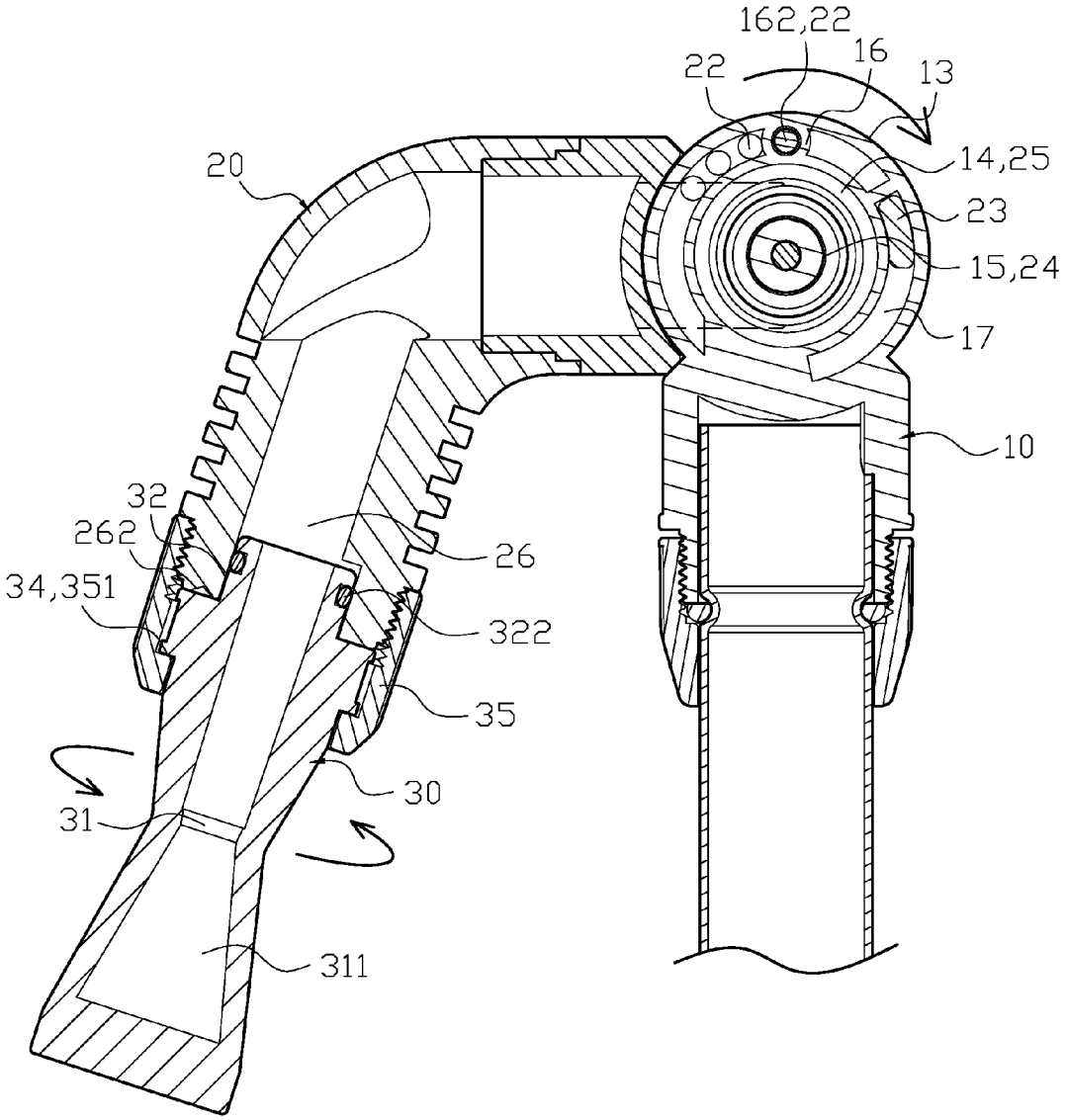
FIG. 3 illustrates a lateral sectional view of the present invention.
Figure 4:
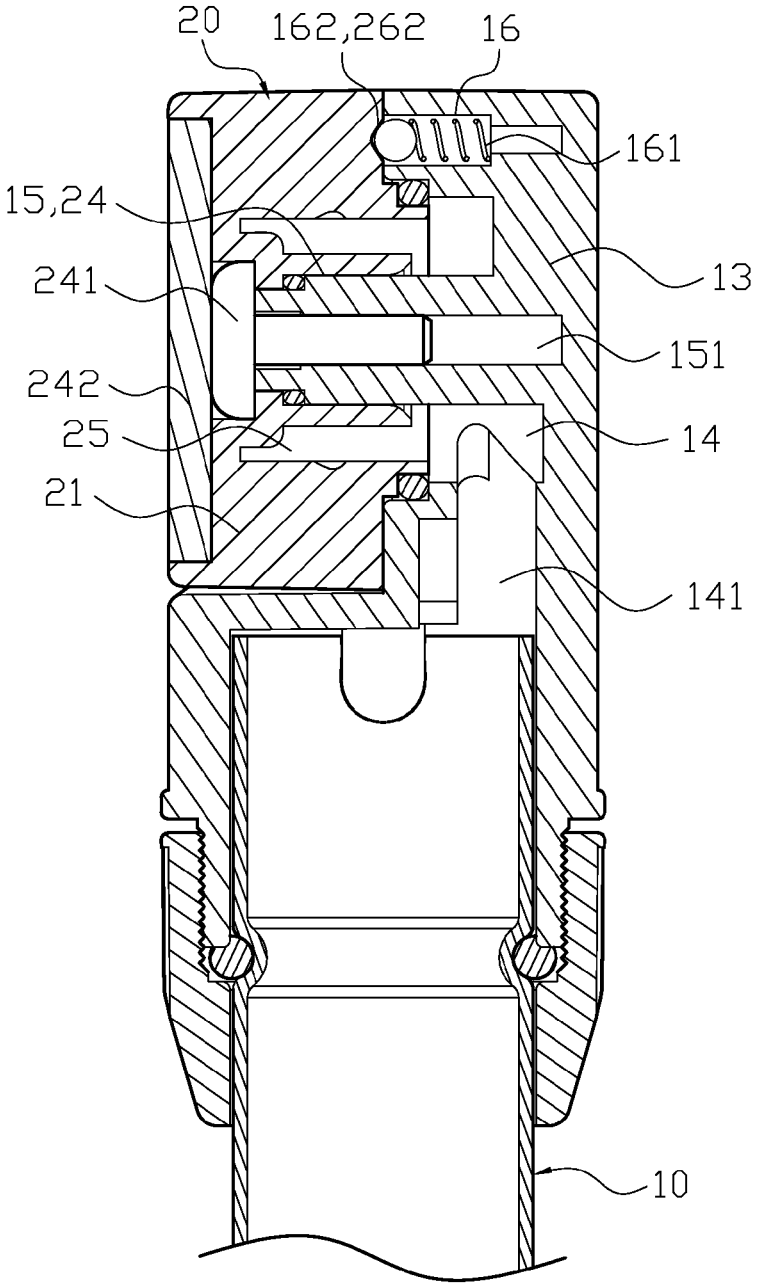
FIG. 4 illustrates a rear sectional view of the present invention.
Figure 5:
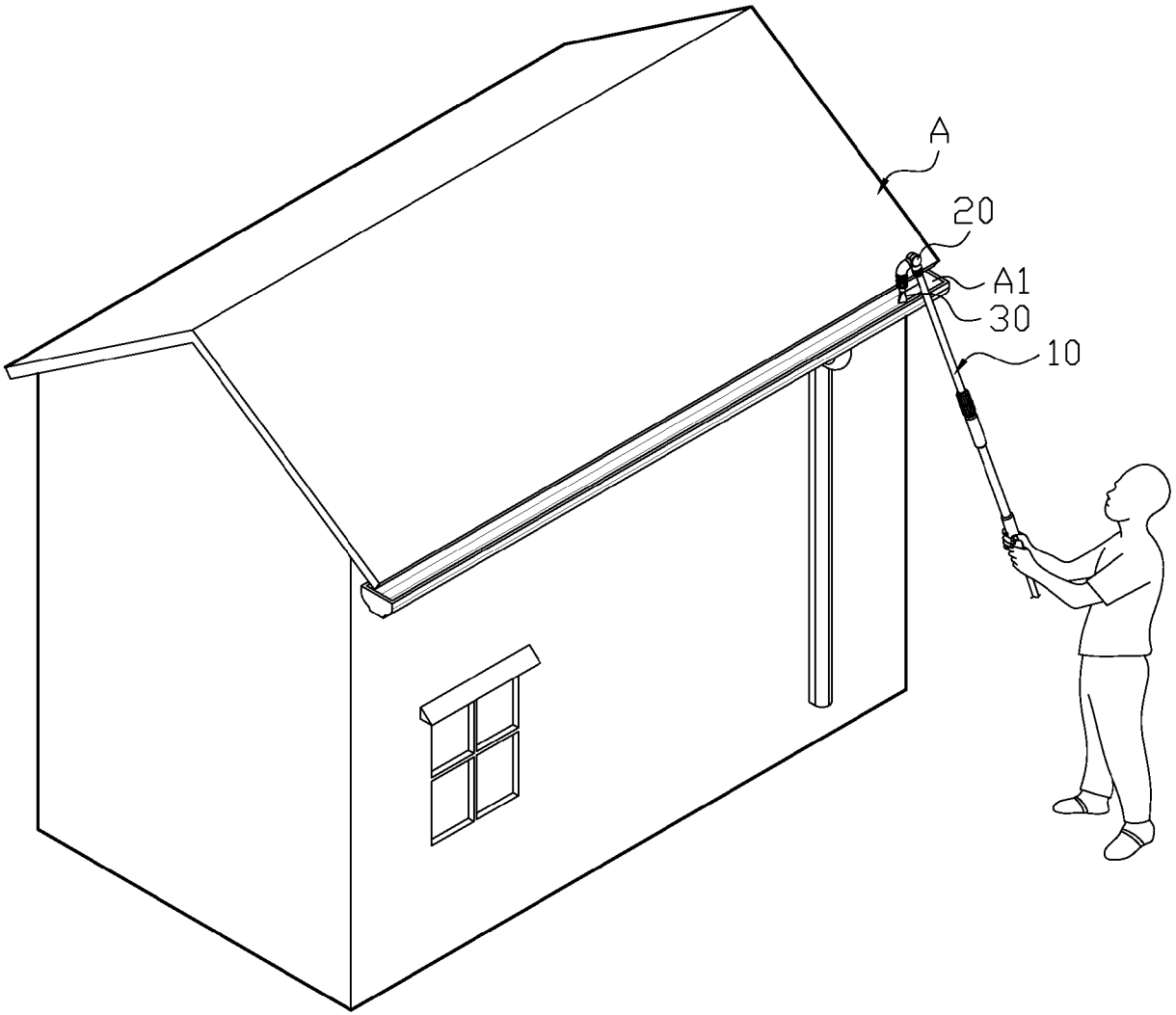
FIG. 5 illustrates a schematic view of the practical usage of the present invention.
Figure 6:
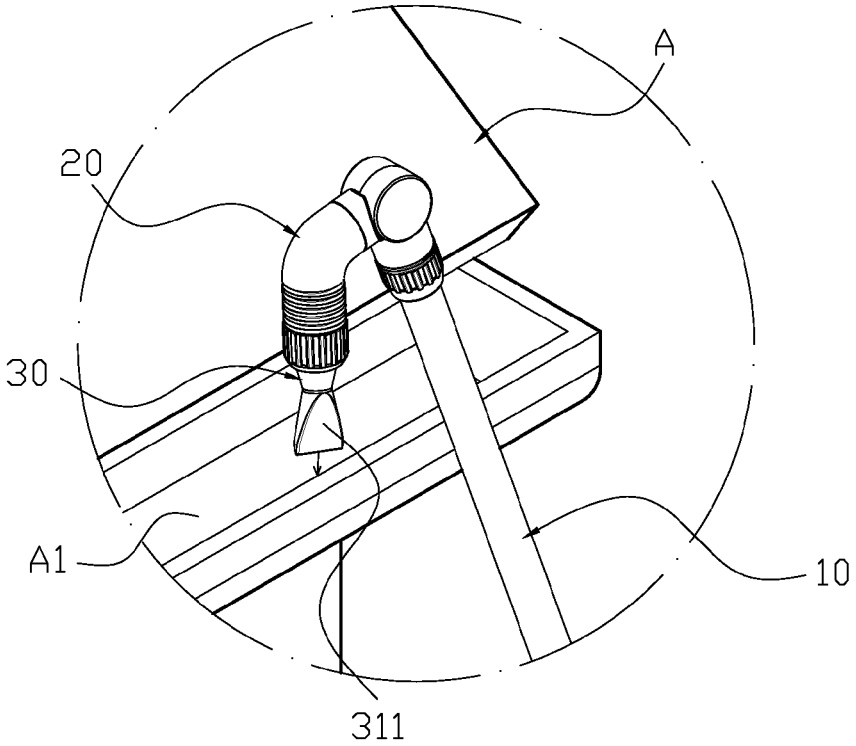
FIG. 6 illustrates a partial enlarging view of FIG. 5 before angle adjustment in the present invention.

Referring to FIGS. 2 and 3 for the assembly of the rack structure, the first spring (161) and the first positioning unit (162) are orderly disposed into the receiving space (16) of the water inlet tube (10), and the water guiding tube (20) is inserted into the rod (15) of the water inlet tube (10) through the through opening (24) of the water guiding tube (20), so that the block (23) of the water guiding tube (20) and the first positioning unit (162) of the water inlet tube (10) are wedged in the restricting slot (17) of the water inlet tube (10) and the first positioning hole (22) of the water guiding tube (20). The restricting unit (241) then passes through the through opening (24) to connect to the connecting hole (151) of the of the water inlet tube (10) to form a secured positioning and complete the assembly of the water inlet tube (10) and the water guiding tube (20). Furthermore, the second spring (331) and the second positioning unit (332) are orderly disposed into the receiving hole (33) of the water spraying head (30), and the water spraying head (30) is plugged into the water outlet end (26) of the water guiding tube (20) through the connecting tube (32), and the restricting cover (35) covers the outer periphery of the water outlet end (26) of the water guiding tube (20), so that the second positioning unit (332) of the water spraying head (30) is wedged in the second positioning hole (262) of the water guiding tube (20), and the semi-circular stopping portion (321) of the water spraying head (30) is against the elongated stopping rib (261) of the water guiding tube (20) to form a secured positioning to complete the assembly process.

Figure 9:
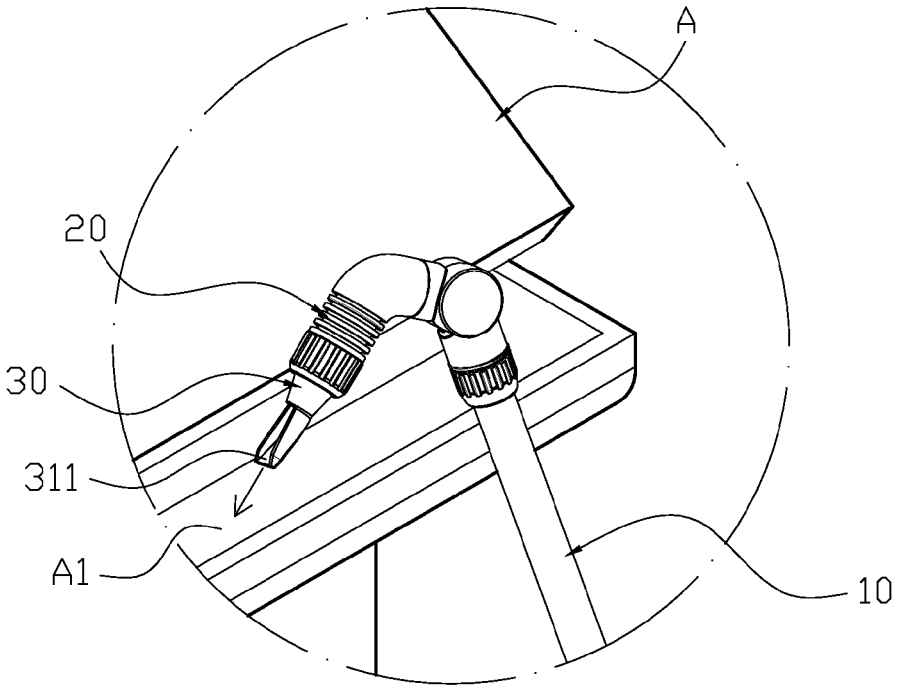
FIG. 9 illustrates a partial enlarging view of FIG. 5 after angle adjustment in the present invention.
Figure 7:
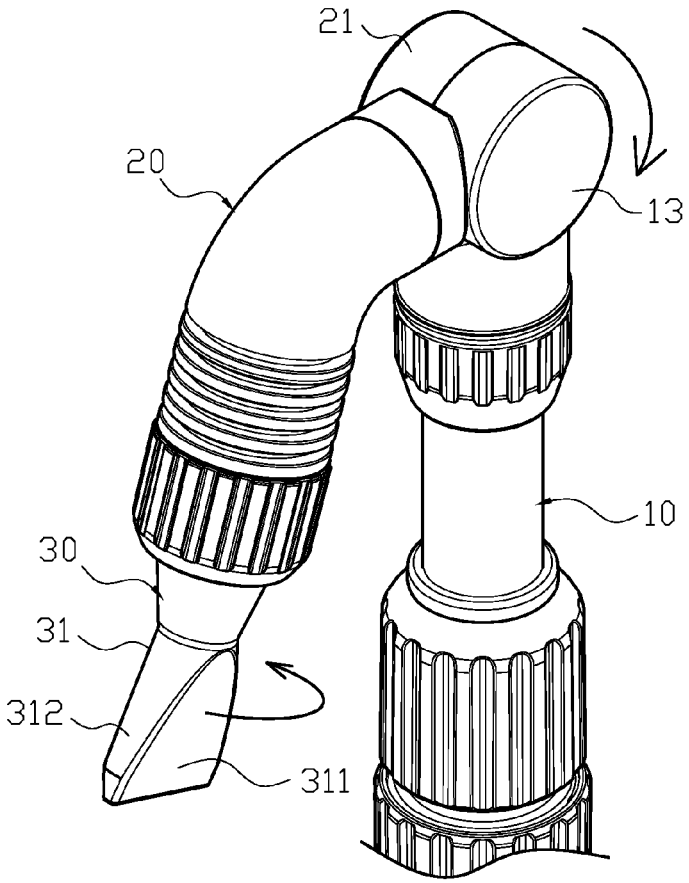
FIG. 7 illustrates a sectional view of the water spraying head and schematic view of twisting the water spraying head in the present invention.
Figure 7:
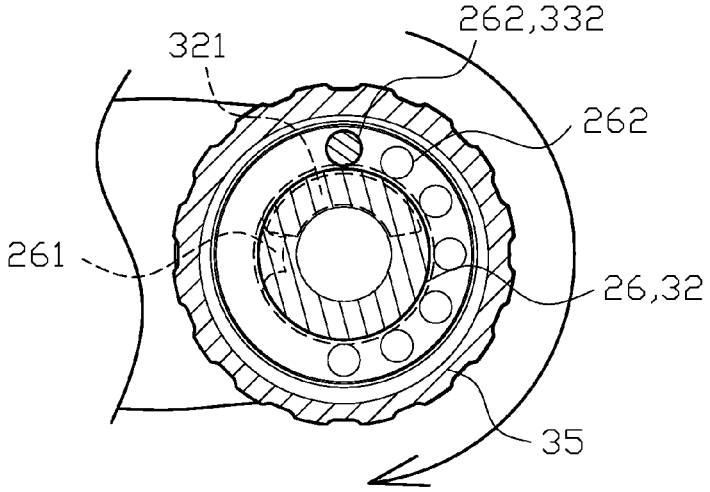
Figure 8:
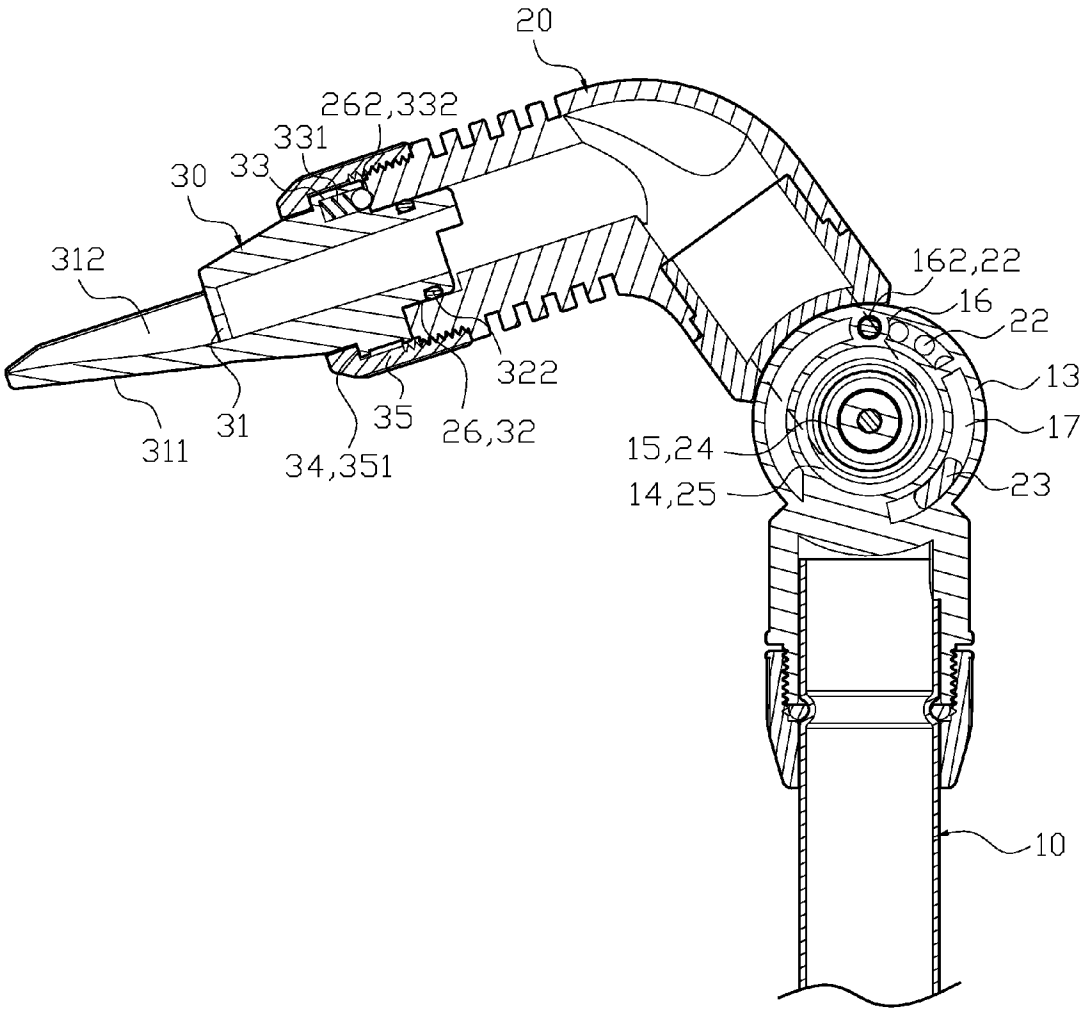
FIG. 8 illustrates a lateral sectional view after angle adjustment in the present invention.
Figure 10:
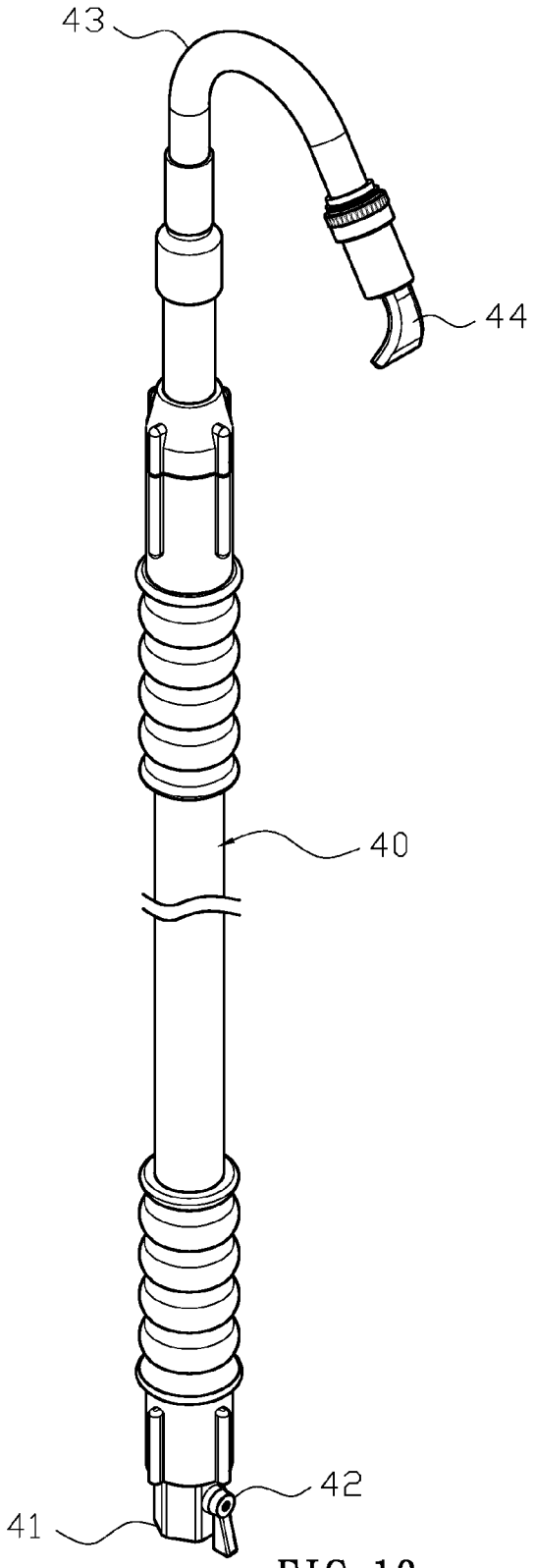
FIG. 10 PRIOR ART
FIG. 10 illustrates a three-dimensional view of a prior art.
Figure 11:
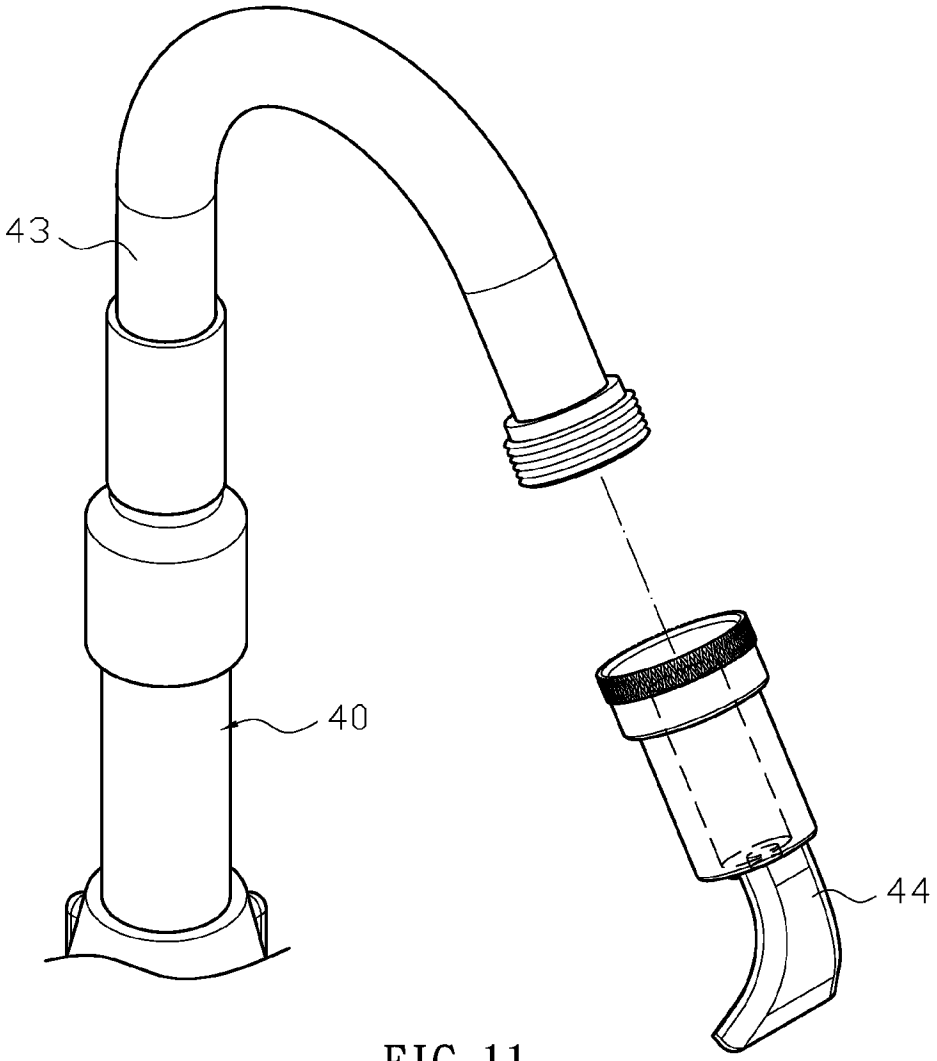
FIG. 11 PRIOR ART
FIG. 11 illustrates a three-dimensional exploded view of a prior art.

Referring to FIGS. 1, 2, 5 and 6 for the washing apparatus in use, when a user wants to clean a water collecting trough (A1) of the eaves (A), the water spraying head (30) is aligned with the water collecting trough (A1) and the water control valve (12) is opened, so the water can flow into the first flowing space (14) and the second flowing space (25) of the water guiding tube (20) through the through hole (141) of the water inlet tube (10), and then flow from the second flowing space (25) to the water outlet end (26) and the water spraying hole (31) of the water spraying head (30) to form a strong water column that impacts the fan-shaped water guiding board (311) and the stopping surface (312) to form a fan-shaped water spraying surface to clean the water collecting trough (A1). Referring to FIGS. 7, 8 and 9, if the user wants to adjust the washing angle, he/she can twist the water guiding tube (20) or water spraying head (30), so that the first positioning unit (162) of the water guiding tube (20) or the second positioning unit (332) of the water spraying head (30) are compressed to pass or position at different angle of the first positioning hole (22) or the second positioning hole (262) to change the angle of elevation of the water guiding tube (20) or the water output direction of the water spraying head (30). Furthermore, adjustment of the water guiding tube (20) and the water spraying head (30) can be either dependent or independent, so the adjustment of the water spraying head is more convenient without frequently moving the water inlet tube (10), which causes water randomly spraying.

According to the embodiments discussed above, the present invention is advantageous because it can change the angle of elevation of the water guiding tube (20) or the water output direction of the water spraying head (30). Furthermore, adjustment of the water guiding tube (20) and the water spraying head (30) can be either dependent or independent, so the adjustment of the water spraying head is more convenient without frequently moving the water inlet tube (10), which causes water to spray randomly.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A washing apparatus with an adjustable water spraying head comprising:

a water inlet tube having a first connecting base located on one side above the water inlet tube; a first flowing space recessedly formed in the first connecting base; a through hole formed at one side of the first flowing space to connect to the water inlet tube, wherein a rod is protrudingly formed at the center of the first flowing space, and a connecting hole is recessedly formed at the rod, and a receiving space is formed outside the first flowing space receiving a first spring and a first positioning unit;

a water guiding tube having a second connecting base formed behind the water guiding tube and engaging with the first connecting base of the water inlet tube, wherein a plurality of first positioning holes are circularly formed at the engaging side of the second connecting base, and one of the first positioning holes is against the first positioning unit of the water inlet tube, wherein a through opening is provided for the rod of the water inlet tube at the center of the engaging side, and the other side of the through opening has a restricting unit passing through the through opening to engage with the connecting hole of the water inlet tube, wherein a second flowing space is recessedly formed between the through opening and the first positioning hole corresponding to the first flowing space, and a water outlet end is formed underneath the water guiding tube to connect with the second flowing space, and a plurality of second positioning holes are circularly formed at the opening of the water outlet end; and a water spraying head having a water spraying hole located underneath the water spraying head; a connecting tube extending from the water spraying head to plug into the water outlet end of the water guiding tube; a receiving hole recessedly formed outside the connecting tube, wherein the receiving hole has a second spring and a second positioning unit, and the second positioning unit is against the second spring and located at one of the second positioning holes of the guiding tube, wherein an elongated stopping rib is protrudingly formed at an inner periphery of the water outlet end, and a semi-circular stopping portion is protrudingly formed at an upper portion of the connecting tube of the water spraying head, and the stopping portion is against the stopping rib of the water guiding tube to form a stopping and secured position.

2. The washing apparatus of claim 1, wherein a water inlet end is formed underneath the water inlet tube, and a water control valve is located near the water inlet end.

3. The washing apparatus of claim 1, wherein a restricting slot is recessedly formed near the receiving space, and the water guiding tube has a block disposed near the first positioning hole, and the block is inserted into the restricting slot of the water inlet tube, and against both sides of an opening of the restricting slot to form a secured position.

4. The washing apparatus of claim 1, wherein the side opposite the engaging side of the second connecting base of the water guiding tube is sealed by a cover.

5. The washing apparatus of claim 1, wherein a flow guiding board extends from the edge of the water spraying hole, and the flow guiding board has a stopping surface on both sides thereof.

6. The washing apparatus of claim 5, wherein the flow guiding board is fan-shaped.

7. The washing apparatus of claim 1, wherein the connecting tube of the water spraying head has a sealing gasket on the body of the connecting tube.

8. The washing apparatus of claim 1, wherein the water spraying head has a connecting edge protrudingly formed at an outer periphery thereof and a restricting cover, one end of which covers an outer periphery of the water outlet end of the water guiding tube, and an engaging edge is protrudingly formed at an inner periphery of the other end, and the engaging edge is against the connecting edge to form a restricting position.

* * * * *